US006837932B2

(12) United States Patent
Pankake

(10) Patent No.: US 6,837,932 B2
(45) **Date of Patent: *Jan. 4, 2005**

(54) PRESSURE FEED COATING APPLICATION SYSTEM

(76) Inventor: Eugene A. Pankake, 2499 Fuquay Rd., Newburgh, IN (US) 47630-8134

( * ) Notice: Subject to any disclaimer, the term of this patent is extended or adjusted under 35 U.S.C. 154(b) by 0 days.

This patent is subject to a terminal disclaimer.

(21) Appl. No.: 10/707,278

(22) Filed: Dec. 2, 2003

(65) Prior Publication Data

US 2004/0112283 A1 Jun. 17, 2004

Related U.S. Application Data

(63) Continuation of application No. 09/678,228, filed on Oct. 2, 2000, now Pat. No. 6,656,529, which is a continuation of application No. PCT/US99/10819, filed on May 18, 1999.

(60) Provisional application No. 60/086,047, filed on May 19, 1998.

(51) Int. Cl.[7] ..... B05C 3/02

(52) U.S. Cl. ..... 118/413; 118/259; 118/261

(58) Field of Search ..... 118/261, 413, 118/419, 414, 302, 206, 203, 104, 126, 121–123, 258, 259, 320, 244, 249, 248, 262

(56) References Cited

U.S. PATENT DOCUMENTS

| | | | |
|---|---|---|---|
| 2,761,419 | A | 9/1956 | Mercier et al. |
| 3,079,889 | A | 3/1963 | Jacobs et al. |
| 3,131,092 | A | 4/1964 | Coghill |
| 3,192,895 | A | 7/1965 | Galer |
| 3,301,214 | A | 1/1967 | Coghill |
| 3,486,482 | A | 12/1969 | Hunger |
| 3,526,528 | A | 9/1970 | Takahashi et al. |
| 3,884,611 | A | 5/1975 | Anderson et al. |
| 3,940,221 | A | 2/1976 | Nissel |
| 4,142,010 | A | 2/1979 | Pipkin et al. |
| 4,257,343 | A | 3/1981 | Kullander |
| 4,327,662 | A | 5/1982 | Damrau |
| 4,332,543 | A | 6/1982 | Fulton et al. |
| 4,351,264 | A | 9/1982 | Flaum et al. |
| 4,385,960 | A | 5/1983 | Zodrow et al. |
| 4,480,583 | A | 11/1984 | Tanaka et al. |
| 4,480,898 | A | 11/1984 | Taylor |
| 4,836,133 | A | 6/1989 | Wohrle |
| 4,839,201 | A | 6/1989 | Rantanen et al. |
| 5,099,786 | A | 3/1992 | Shibata et al. |
| 5,136,972 | A | 8/1992 | Naka et al. |
| 5,208,078 | A | 5/1993 | Ishibashi et al. |
| 5,234,500 | A | 8/1993 | Korokeyi |
| 5,318,804 | A | 6/1994 | Yoshida |
| 5,320,679 | A | 6/1994 | Derezinski et al. |
| 5,329,964 | A | 7/1994 | Derezinski |

(List continued on next page.)

FOREIGN PATENT DOCUMENTS

| | | |
|---|---|---|
| DE | 42 41 792 A1 | 6/1994 |

*Primary Examiner*—Brenda A. Lamb
(74) *Attorney, Agent, or Firm*—Oppedahl & Larson LLP

(57) ABSTRACT

The present invention includes a device and a method of applying a coating to a web. The preferred device comprises a feed nozzle coupled to a stiffener coupled to a spring coupled to a position/force adjuster. The feed nozzle comprises a fluid reservoir, a feed pipe, a metering surface, end seals and a back seal. The stiffener spring, as the frame deflects and polymer covered rolls deform, permits the rotation of the feed nozzle so a proper geometry is maintained, permitting increased control and a wider film thickness control range for a specific nozzle shape. This device permits greater film thickness control, ability to process at much higher speeds than currently achievable, and a wider range of film thickness. This device permits coatings to be applied at much wider ranges of rheological characteristics. Coatings can be applied at higher percent solids with improved characteristics. Multiple feed nozzles provide rapid product changeover for greater equipment utilization and higher productivity.

10 Claims, 16 Drawing Sheets

U.S. PATENT DOCUMENTS 5,395,653 A 3/1995 Baum
5,411,589 A 5/1995 Yoshida et al.
5,435,847 A 7/1995 Shibata et al.
5,484,482 A 1/1996 Rantanen et al.
5,674,319 A 10/1997 Slobodkin
5,743,964 A 4/1998 Pankake
5,807,434 A 9/1998 Innes
6,004,394 A 12/1999 Gottwald
6,106,900 A 8/2000 Innes et al.

PRESSURE FEED COATING APPLICATION SYSTEM

STATEMENT OF RELATED APPLICATIONS

This application is a continuation of U.S. application Ser. No. 09/678,228, filed Oct. 2, 2000, now U.S. Pat. No. 6,656,529, issued Dec. 2, 2003, which is a continuation of U.S. Appl. No. PCT/US99/10819 designating the United States, filed May 18, 1999, and from U.S. Provisional application 60/086,047, filed May 19, 1998, which are hereby incorporated by reference.

BACKGROUND

The present invention relates to systems for applying coatings under pressure to a web of material. A variety of coatings may be used, such as, but not restricted to, solvent- or water-based coatings, and the web may be made of a variety of materials, such as, but not restricted to, steel, aluminum, textiles, paper or film. U.S. Pat. No. 5,743,964 "Pankake" is an example of prior art roll coating.

The primary known technology for application of film in the range of 1 milligram per square inch to 30+milligrams per square inch of fluid on a substrate at speeds greater than 250 feet per minute involves a process known as roll coating. This involves picking up a fluid out of an open pan with a pick-up roll or feeding the fluid by gravity into a top nip. (A nip is the pinch point between rollers.) The fluid is then transferred from that roll to the next or is transmitted through a nip to the next roll. Eventually, the fluid is transferred from a roll to the web.

Another approach commonly used for applying fluid to a substrate involves the use of a die or slot. This process is normally limited to speeds up to approximately 200 feet per minute. The fluid may be deposited onto a roll for transfer to the substrate or directly onto the substrate with this method.

Coating being picked up out of a pan, sprayed, or nip fed is exposed to ambient conditions and the atmosphere. This permits dry out or skinning-over and evaporation of volatiles that contribute to product variability and environmental pollution, foaming, and splashing. Numerous other defects are also associated with unstable or uncontrolled fluid dynamics that occur at the entry point of the roll into the fluid contained in the pan, the exit point of the roll out of the fluid in the pan, or at the nip point. Some of these defects are often labeled as skips, seashore, ribbing, blisters, voids, shinnies, or splotching. The fluid picked up out of a pan is susceptible to being slung from the roll ends, creating a safety hazard, product defects, and a mess.

The appearance and thickness of the applied fluid is governed by a very complex relationship between the equipment configuration, equipment settings, and the fluid characteristics. Some of these variables include the number of rolls, direction of rotation of the rolls, roll material, roll finish, roll diameter, roll hardness, roll geometry, nip pressures, fluid viscosity, and fluid rheology. The relationships of all of these variables in the roll coatings process today provide a relatively small window for successful application of a specific fluid at a specific thickness. Fluids are very often applied at viscosities of 10 to 500 centistokes, depending on the desired applied film thickness. This requires the addition of large volumes of solvents or carrier fluid in many cases. The evaporation of these large volumes of solvents into the atmosphere is very undesirable from an environmental standpoint. Also, since the solvents evaporate from the open pan during the process, the characteristics of the coating are constantly changing during the process, making it very difficult to control the process.

The set-up of the above process must also be done in a way to achieve the desired film thickness while minimizing an appearance defect known as ribbing in the roll coating process. Typically, fluids are reduced in viscosity, and long flow-out zones are provided. These flow-out zones permit the ribs to be leveled out.

The use of open pans also creates major limitations to rapid, repeatable product changes. Typically, a product change for a pan feed system requires to between 10 minutes and several hours. To achieve product changes in less than 30 minutes usually requires additional investments of millions of dollars in capital equipment and labor intensive activities on major web processing lines.

As will be seen from the subsequent description of the preferred embodiments of the present invention, these and other limitations and shortcomings of the prior art are overcome by the present invention.

SUMMARY OF THE INVENTION

The present invention includes a device for and a method of-applying a coating to a material web such as, but not restricted to, a sheet of steel, aluminum, textile, paper, or film. An elongated feed nozzle is used to feed coating material under pressure. The pressure may be supplied by gravity or by a low pressure pump. The feed nozzle seals-up against either the web or a roll. The feed nozzle includes a fluid reservoir, a metering surface, end seals (end closures) and a back seal. The fluid reservoir, in conjunction with the end seals and the back seal, forms a cavity which contains the fluid as it is being fed through the feed nozzle. This avoids all the problems of having the coating in open trays. The present invention further provides a mechanism for rotating one nozzle out of the operating position and another nozzle into operating position,permitting a very quick change of coatings. With this arrangement, the nozzle that is off-line can be cleaned and prepared while the on-line nozzle is operating. The present invention also provides a support spring, which supports the nozzle and provides automatic position adjustment of the nozzle in response to the amount of force being exerted by the nozzle. The preferred embodiment also provides a nozzle contact angle adjustment mechanism, a mechanism to adjust the profile of the metering surface, a feed nozzle force sensor, a feed nozzle cleaning assembly, and an applicator roll cleaning assembly. A stiffener is used to make the metering surface rigid. The stiffener can be integral with the feed nozzle, or a separate stiffener can be attached to the feed nozzle. A preferred embodiment permits feed nozzle force control and contact surface angle control to be operated independently of one another, which cannot be achieved with die or slot coating. These technologies require precise control of clearances. The support spring, as the frame deflects and polymer covered rolls deform, permits the rotation of the feed nozzle to maintain a proper geometry, permitting increased control and a wider film thickness control range for a specific nozzle shape. The additional dynamic actuators of nozzle force and metering surface add new quality, speed and film thickness capability to web coating. Dynamic feed nozzle force control can be accomplished independent of reservoir cavity pressure and metering surface contact angle.

The feed nozzle and support frame can include a profile adjustment device to control the bending or profile across the feed nozzle bar, permitting variable coating thickness profiles or correcting variable thickness profiles across the web with this feed system. While the profile control of the housing or support is manual in the prototype described herein, the control can be done via hydraulic cylinders, stepper motors, pneumatic cylinders, manual linkages, etc. The profile control is not limited to the aforementioned but may be done in any manner that will permit controlled and repeatable flexing of the member.

Control of pressurized coating and coating build-up at ends of the feed bar is accomplished by means of an end seal in the feed nozzle bar. The end seal may have several different configurations.

The back seal may be made of any flexible blade compatible with the coating being applied that will seal and remain sealed against the surface being coated without causing damage. Examples of suitable materials include, but are not restricted to aluminum, steel, and plastic.

DESCRIPTION OF THE DRAWING

FIG. 9B is the same view as. FIG. 9, but with the profile of the feed nozzle having been adjusted;

DETAILED DESCRIPTION

Figure 1:
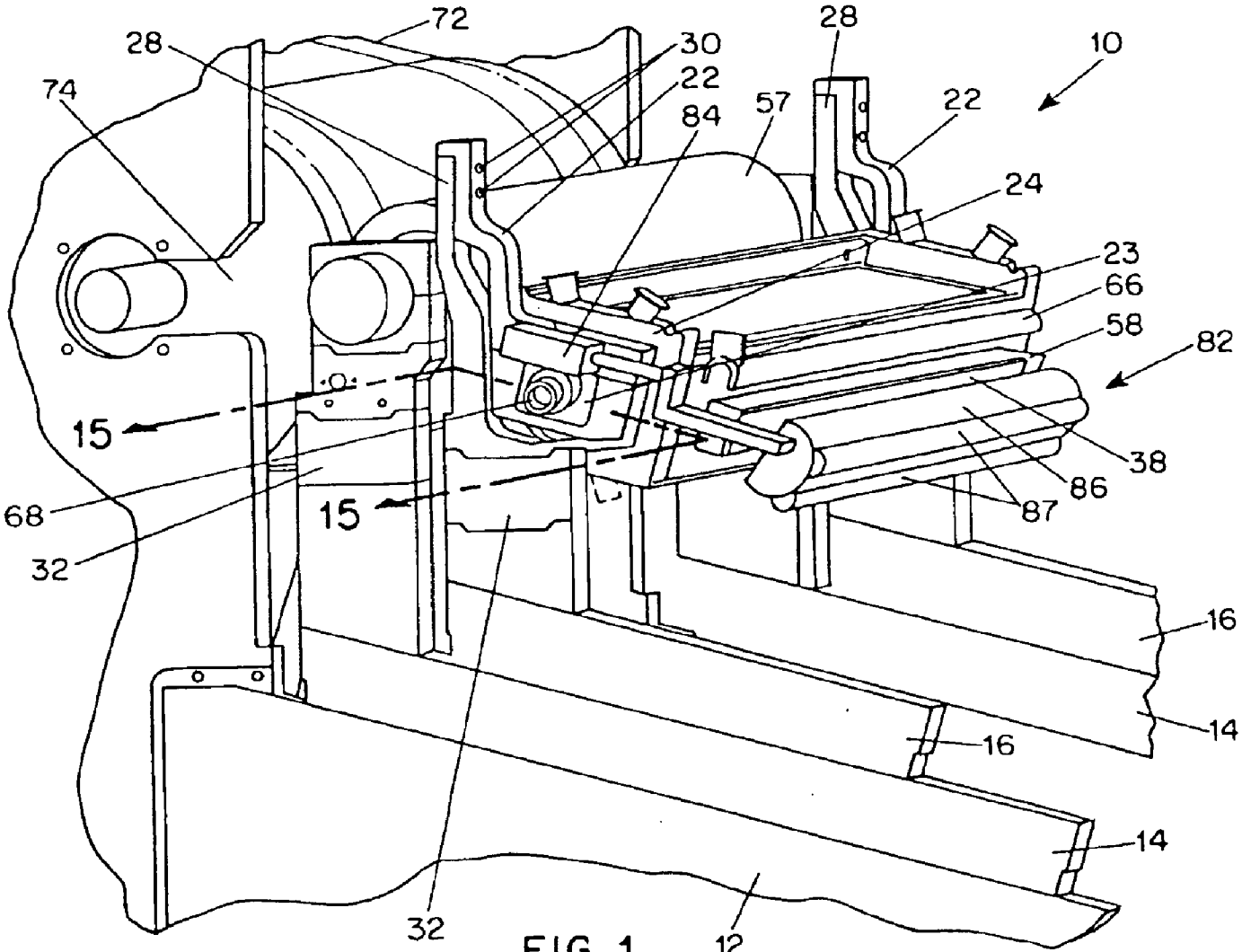
FIG. 1 is a rear perspective view of one example of a coating machine made in accordance with the present invention.
Figure 2:
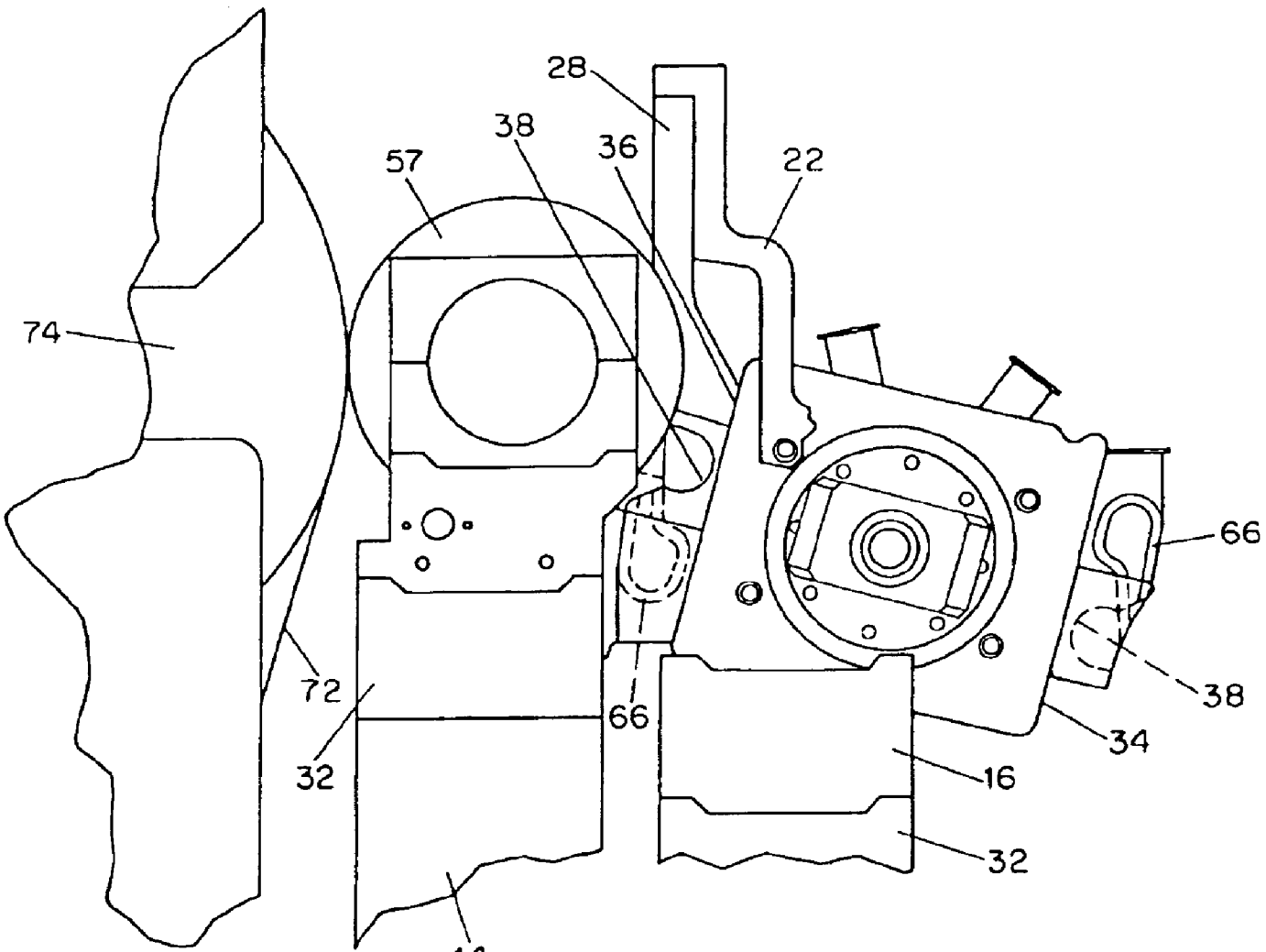
FIG. 2 is a broken-away side view of the machine of FIG. 1.
Figure 3:
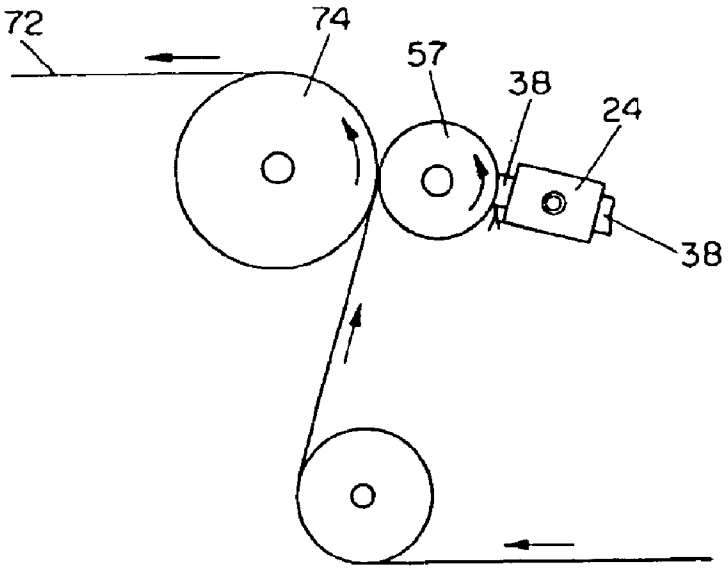
FIG. 3 is a schematic side view showing the web to be coated travelling through the machine of FIG. 1.
Figure 5:
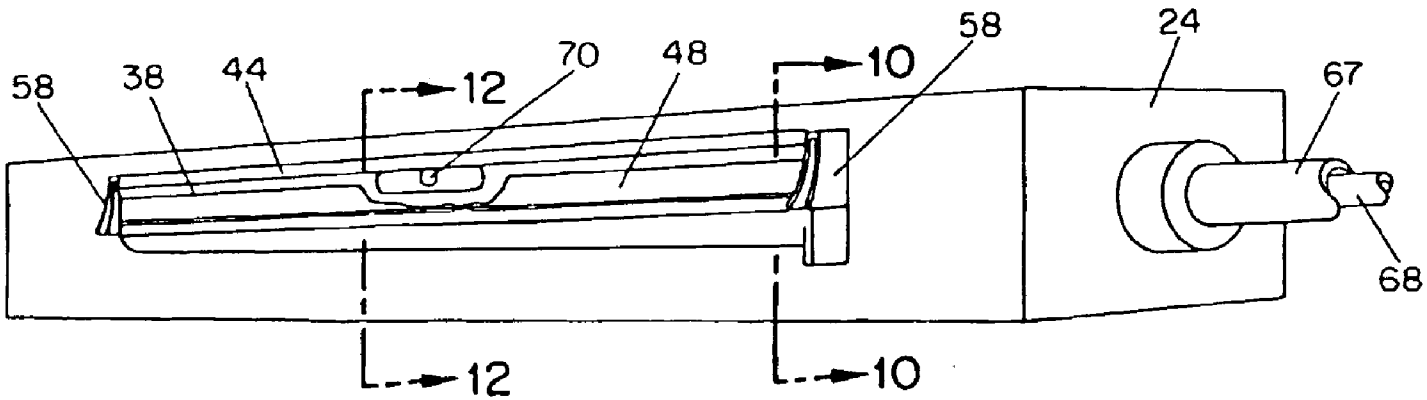
FIG. 5 is a perspective view of the feed nozzle of FIG. 4.
Figure 4:
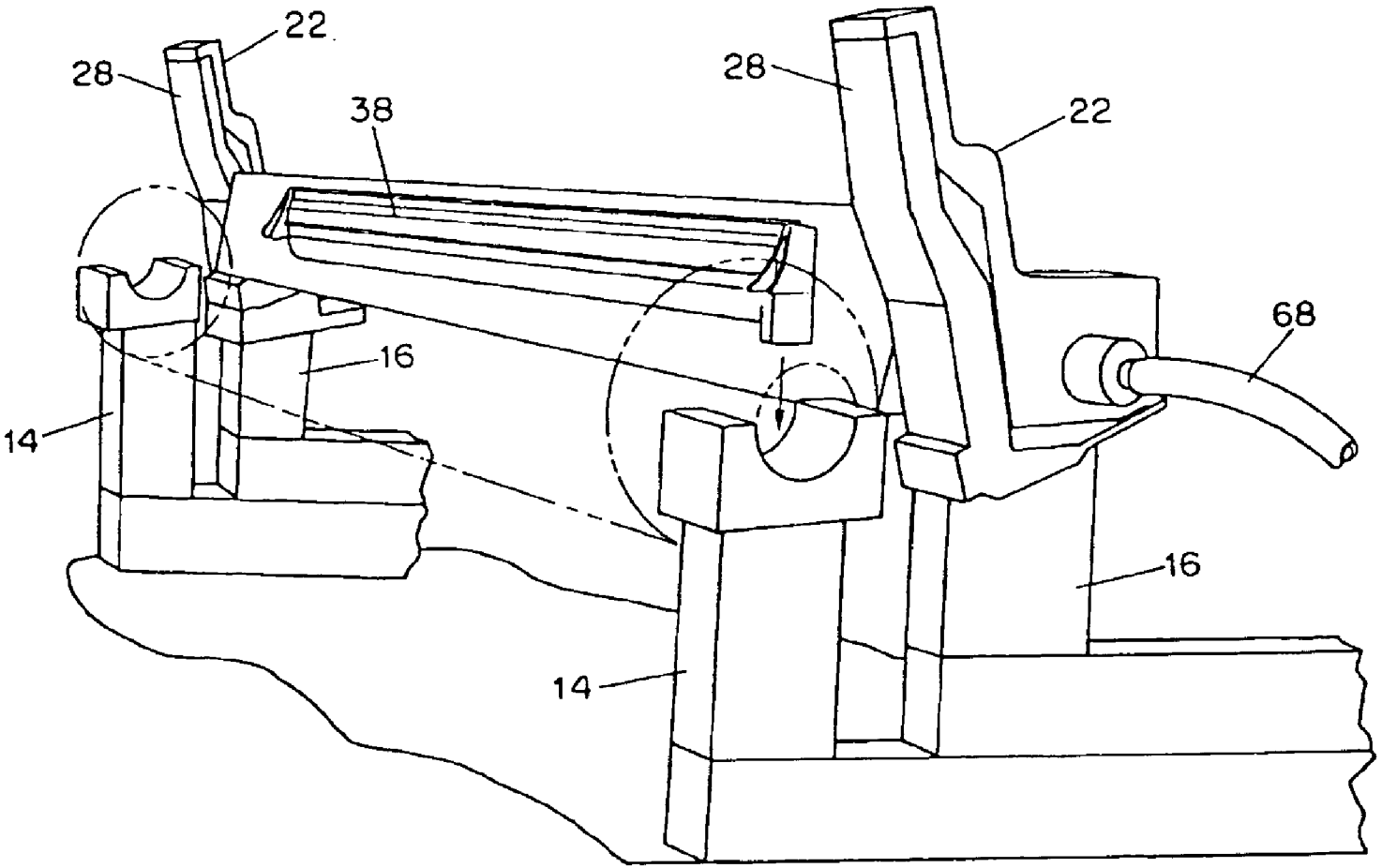
FIG. 4 is a broken-away front perspective view of the feed nozzle and its related support mechanism of the machine of FIG. 1.
Figure 6:
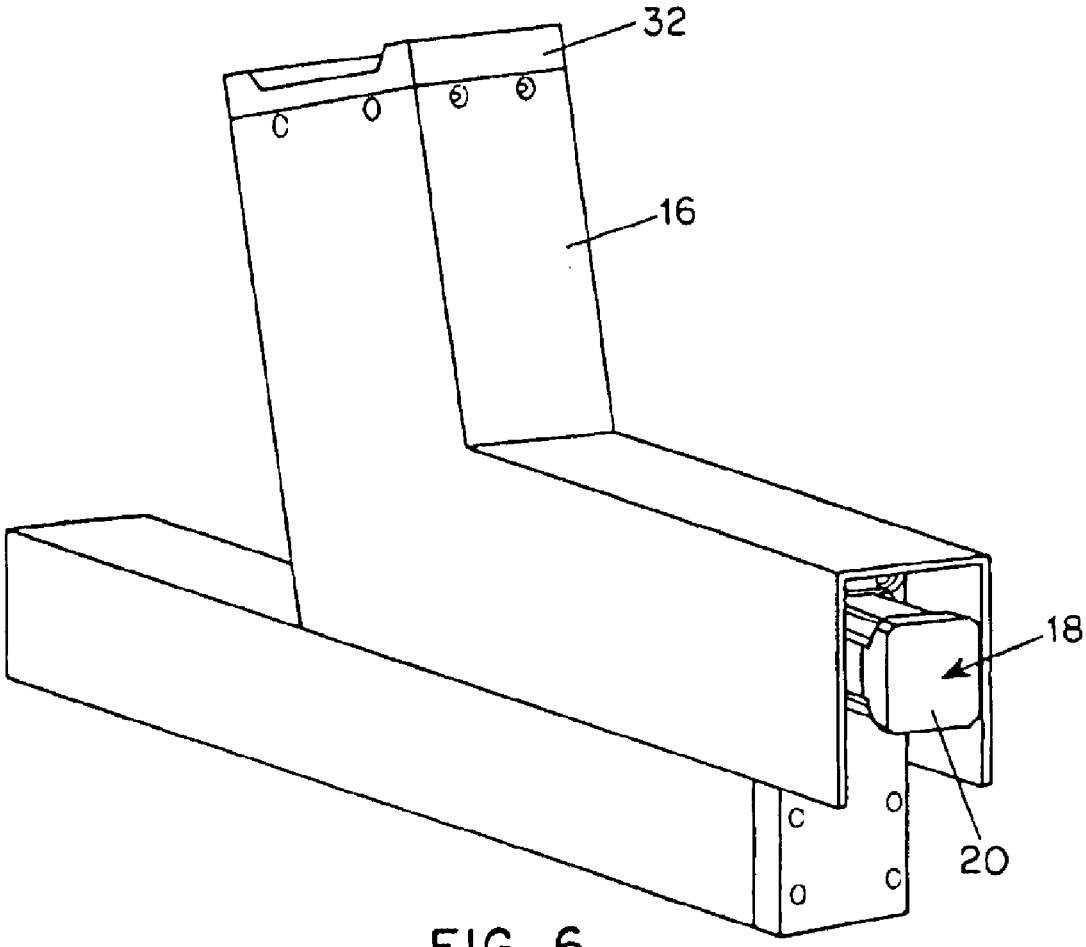
FIG. 6 is a perspective view of the base of the feed nozzle support mechanism of FIG. 4.
Figure 8:
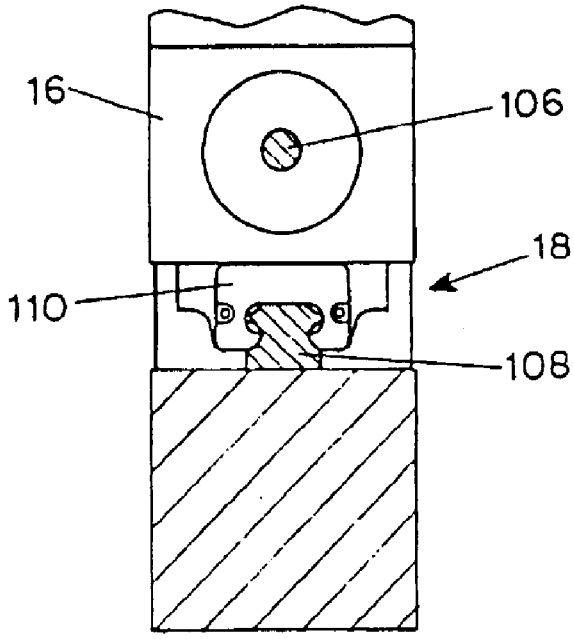
FIG. 8 is a broken-away sectional view of the base of FIG. 7.
Figure 7:
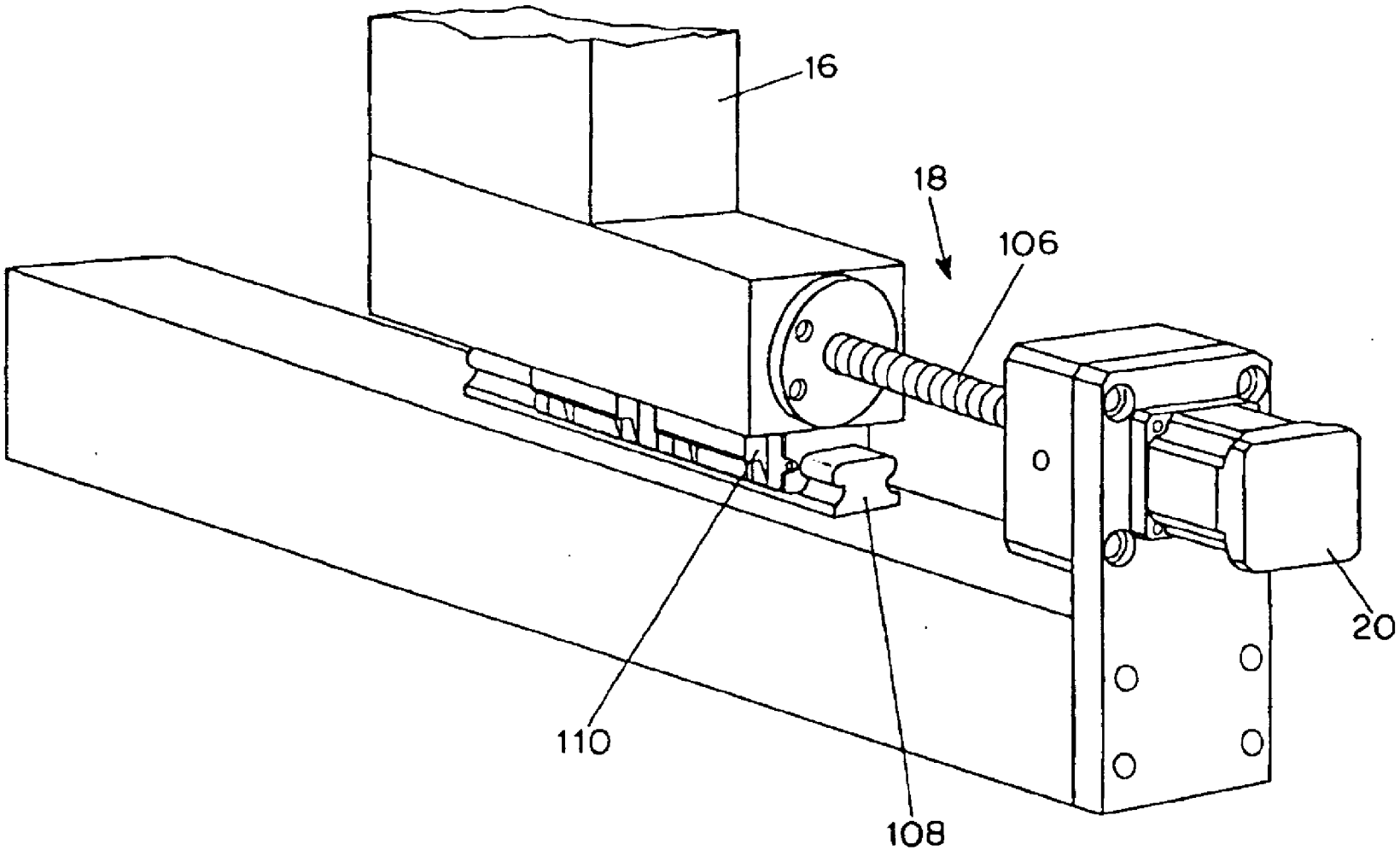
FIG. 7 is the same view as FIG. 6, but with the feed nozzle moved forward.

FIGS. 1–16 show a first preferred embodiment of a system 10 for coating a web of material made in accordance with the present invention. (FIGS. 10A–10C show an alternate embodiment using a different type of seal.) The system 10 includes a stationary base 12, and left and right movable roller support and nozzle support frames 14, 16 mounted on the base 12. The left and right sides of this system 10 are essentially mirror images of each other. Each of the movable frames 14, 16 is mounted on a linear bearing arrangement 18, as shown in FIGS. 6–8, and the position of each movable frame member 14, 16 is controlled by a stepper motor, as will be explained in more detail later. Left and right springs 22 are mounted on the left and right nozzle support frames 16. Mounting blocks 23 are bolted to their respective springs 22. In this preferred embodiment, the springs 22 are leaf springs, although other types of springs could be used. One end of each spring 22 is bolted onto an upwardly-projecting arm portion 28 of its respective nozzle support frame 16 by means of bolts 30. As seen in FIG. 1, the springs 22 permit the nozzle to rotate counterclockwise about a point above the nozzle contact point. A sensor 32 is mounted on each of the support frames 14, 16 to measure the force being applied by and to the respective frame. 14, 16.

Figure 11:
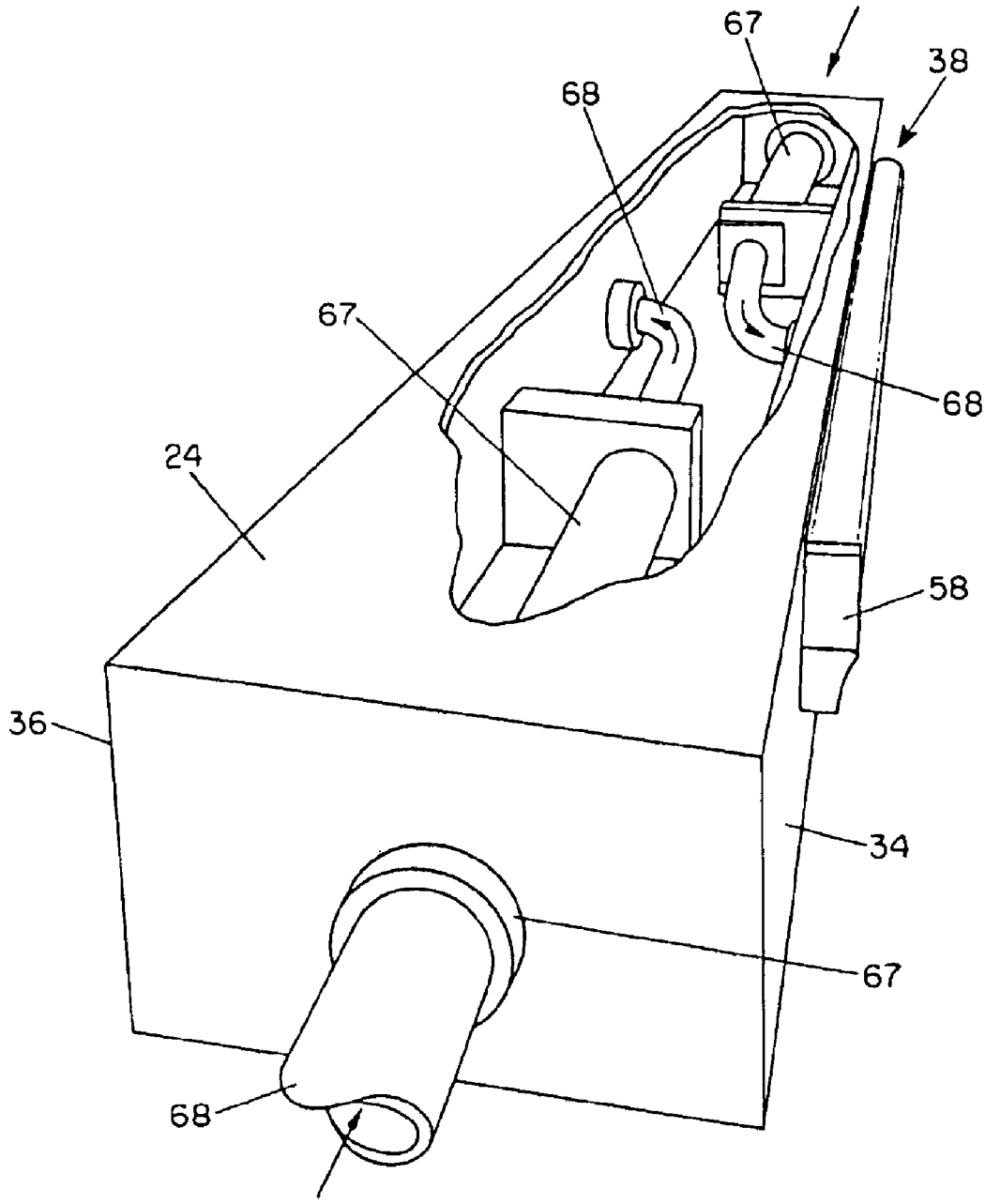
FIG. 11 is a broken-away perspective view of the feed nozzle, stiffener member, and feed pipes of FIG. 1.
Figure 14:
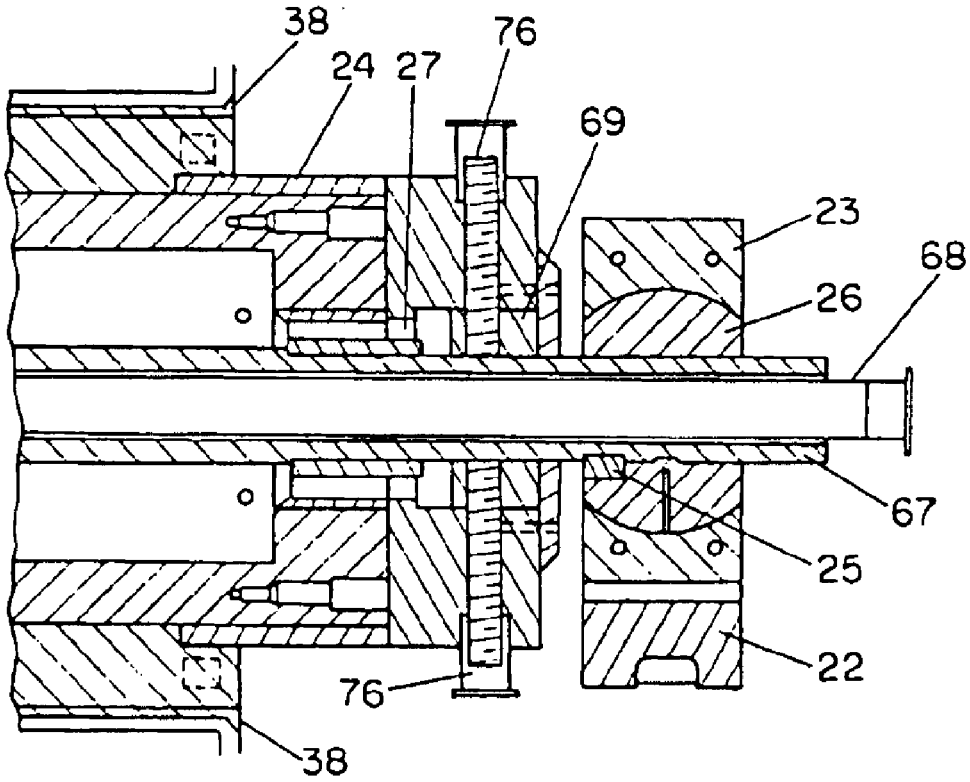
FIG. 14 is a broken-away section view showing one end of the mounting block, stiffener, and feed nozzle of FIG. 1.
Figure 15:
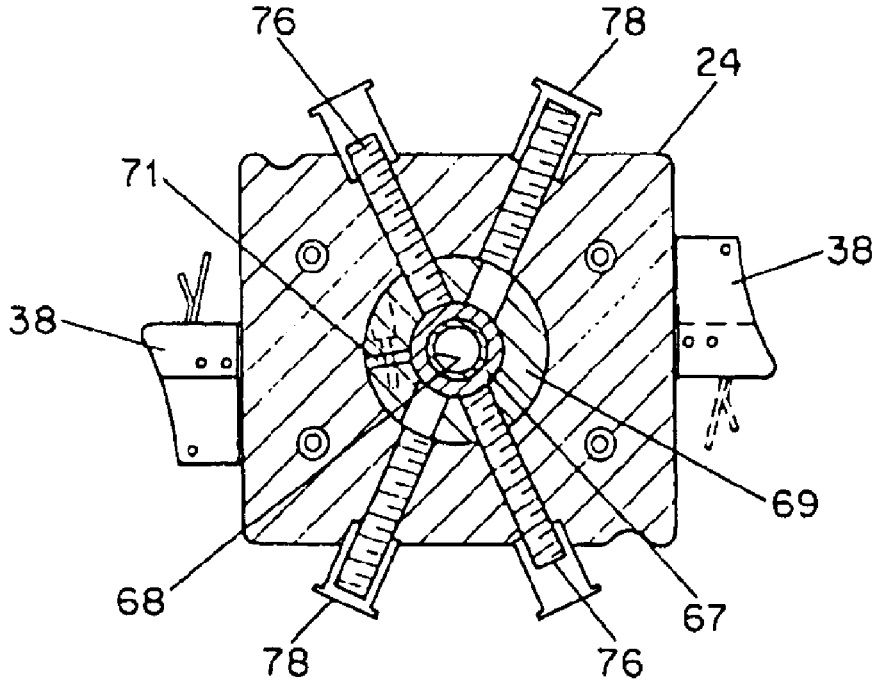
FIG. 15 is a view taken along the line 15—15 of FIG. 1.

Looking at the details in FIGS. 14 and 15, it can be seen that left and right sleeves 67 are keyed by keys 25 to their respective spherical bearings 26 in the mounting blocks 23. A stiffener beam 24 is mounted on the sleeves 67 by means of bearings 27. Locking rings 69 are clamped onto their respective sleeves 67 by means of screws 71, so the locking rings 69, sleeves 67, and spherical bearings 26 are all fixed together. The stiffener beam 24 is locked to the locking rings 69 by means of one set of locking bolts 76 or 78, which fit into respective recesses in the locking rings 69, as shown in FIG. 15. It will be noted that the holes which receive the second set of locking bolts 78 are angularly offset so that the stiffener beam 24 is in a slightly different angular position when the second set of locking bolts 78 is, used. In order to rotate the stiffener beam 24 relative to the sleeves 67, the bolts 76 or 78 are retracted until they clear the locking collar 69, the stiffener beam 24 is rotated 180 degrees, and the respective set of bolts 76 or 78 is then inserted again into the locking collar 69. While this locking mechanism is shown in the prototype, it will be understood that various known types of rotating and locking mechanisms could be used. The feed pipes 68 are fixed at their other ends to the stiffener beam 24, as shown in FIG. 11, so the feed pipes 68 rotate with the stiffener beam 24 relative to the fixed sleeves 67.

The stiffener beam 24 has first and, second opposed, substantially flat walls 34, 36 (see FIG. 2), and a feed nozzle 38 is mounted on each of those walls. The feed nozzles 38 are mounted opposite each other, with one inverted relative to the other so they can be selectively rotated into operating position by rotating the stiffener beam 24 as described above.

Figure 9:
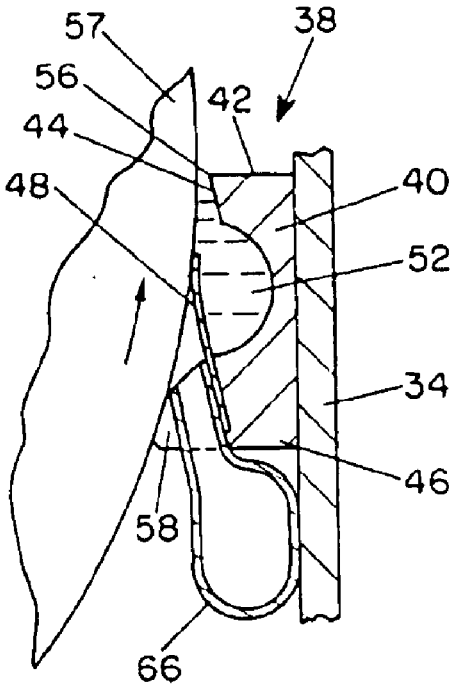
FIG. 9 is a side sectional view taken through the feed nozzle of FIG. 1.

Referring to FIG. 9, each feed nozzle 38 includes a reservoir made up of a rear wall 40, a top wall 42, projecting forward from the rear wall 40, and defining a metering surface 44 at its front edge, a bottom wall 46, and a front wall 48, comprising a flexible back seal. The leading edge of the feed bar or nozzle 38 is sealed using the back seal 48. This back seal 48 is made of a flexible material that runs the full width of the feed nozzle 38. The blade 48 rests against the substrate or applicator roll 57. Contact pressure (sealing pressure) can be developed several different ways. The methods include mechanical deflection or stressing of the back seal 48, deflection of the back seal 48 against the applicator roll 57 or substrate 72 with internal pressure in the feed nozzle, or a combination of the two. The back seal 48 terminates below the metering surface 44, leaving a gap 50 between the back seal 48 and the metering surface 44, through which coating 52 flows during operation of the system.

The downstream edge or application metering surface 44 of the feed nozzle 38 is shaped specifically to provide the desired thickness and appearance characteristics for the specific substrate or roll and fluid. It may be flat, rounded, grooved, or any number of shapes. Generally the metering surface 44 is tapered to provide a wider gap at the lower edge 54 (the leading edge where the roller enters) and a narrower gap at the upper edge 56, the downstream edge where the roller leaves the nozzle 38. As will be explained in more detail later, the metering surface 44 is shaped to provide the desired coating characteristics through hydrodynamic effects along the length of the roll/substrate and metering nip. Harder surfaces or thicker coatings may require a concave shape, while softer surfaces and thicker coatings may use flat or convex metering surface 44 contours.

The ends of the feed nozzle 38 are sealed to the roll 57 (or substrate 72) by the end seals 58 to ensure the inside of the feed nozzle 38 remains evenly pressurized across its entire width. The end seals 58 may-be a labyrinth design seal as shown, or they may be mechanically contacting seals or pressurized fluid seals depending on the lubricity of the coating. The gap 50 between the back seal 48, the metering surface 44, and the end seals 58 is bridged by the roll 57 (or substrate 72). Fluid in the nozzle or feed bar 38 first contacts the roll 57 (or substrate 72) as the surface of the roll 57 passes the top of the back seal 48, and the thickness of the coating fluid on the roll 57 (or substrate 72) is determined by the gap between the metering surface 44 and the roll as well as by the viscosity of the fluid and the hydrodynamics as the roll rotates past the metering surface 44.

Figure 9A:
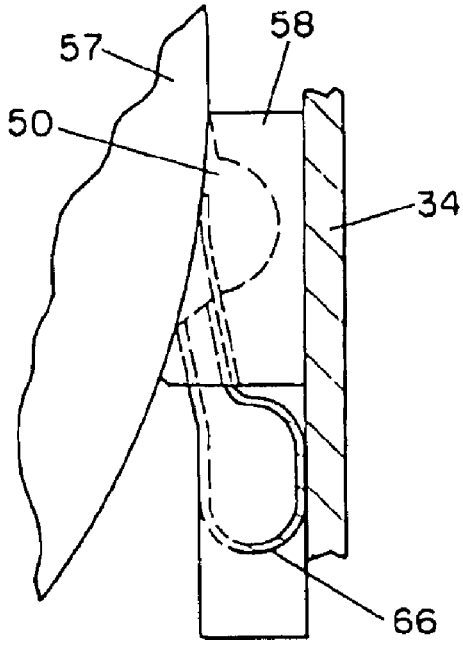
FIG. 9A is a side view showing the feed nozzle of FIG. 9.
Figure 10:
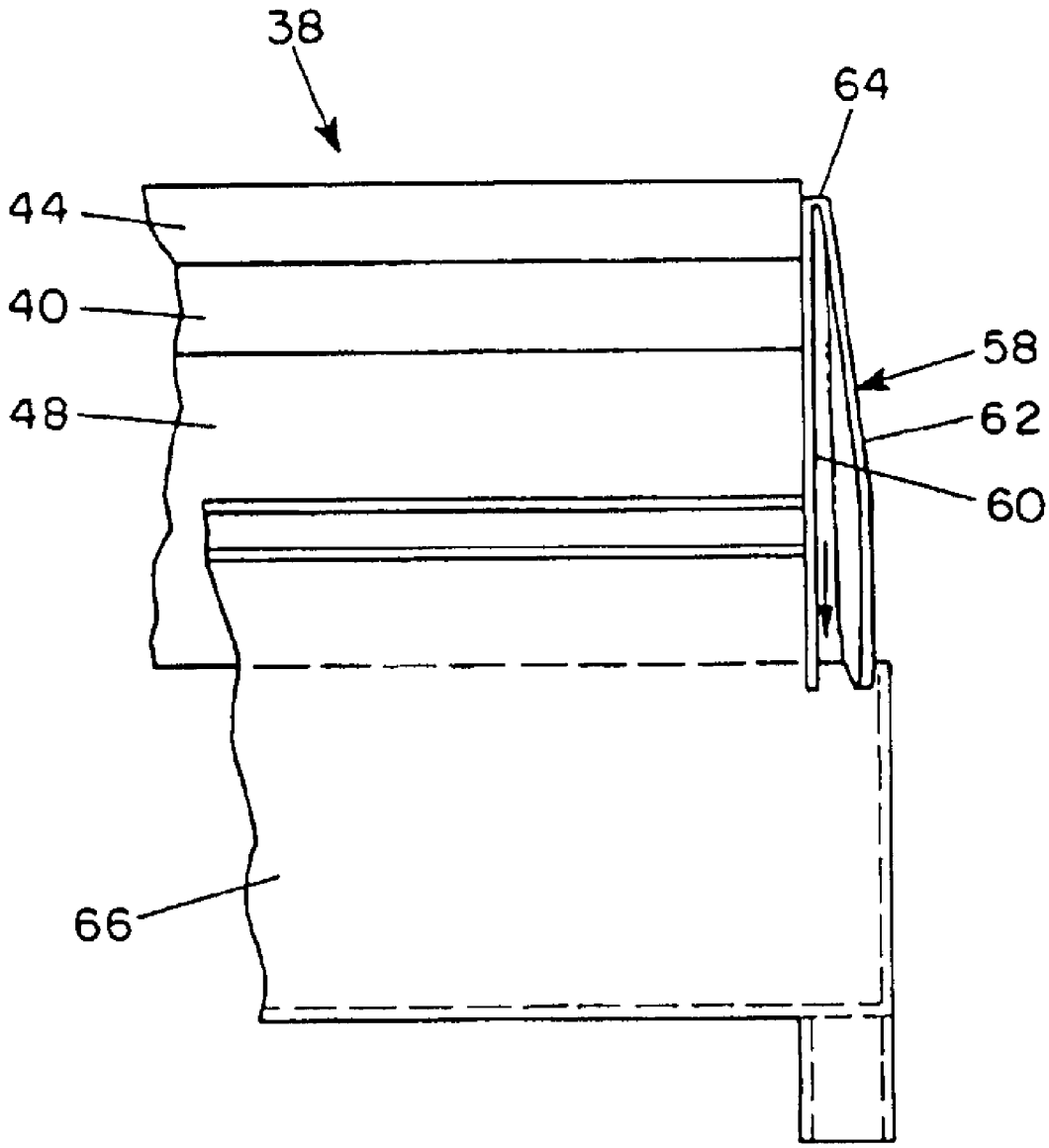
FIG. 10 is a view taken along the line 10—10 of FIG. 5.
Figure 10A:
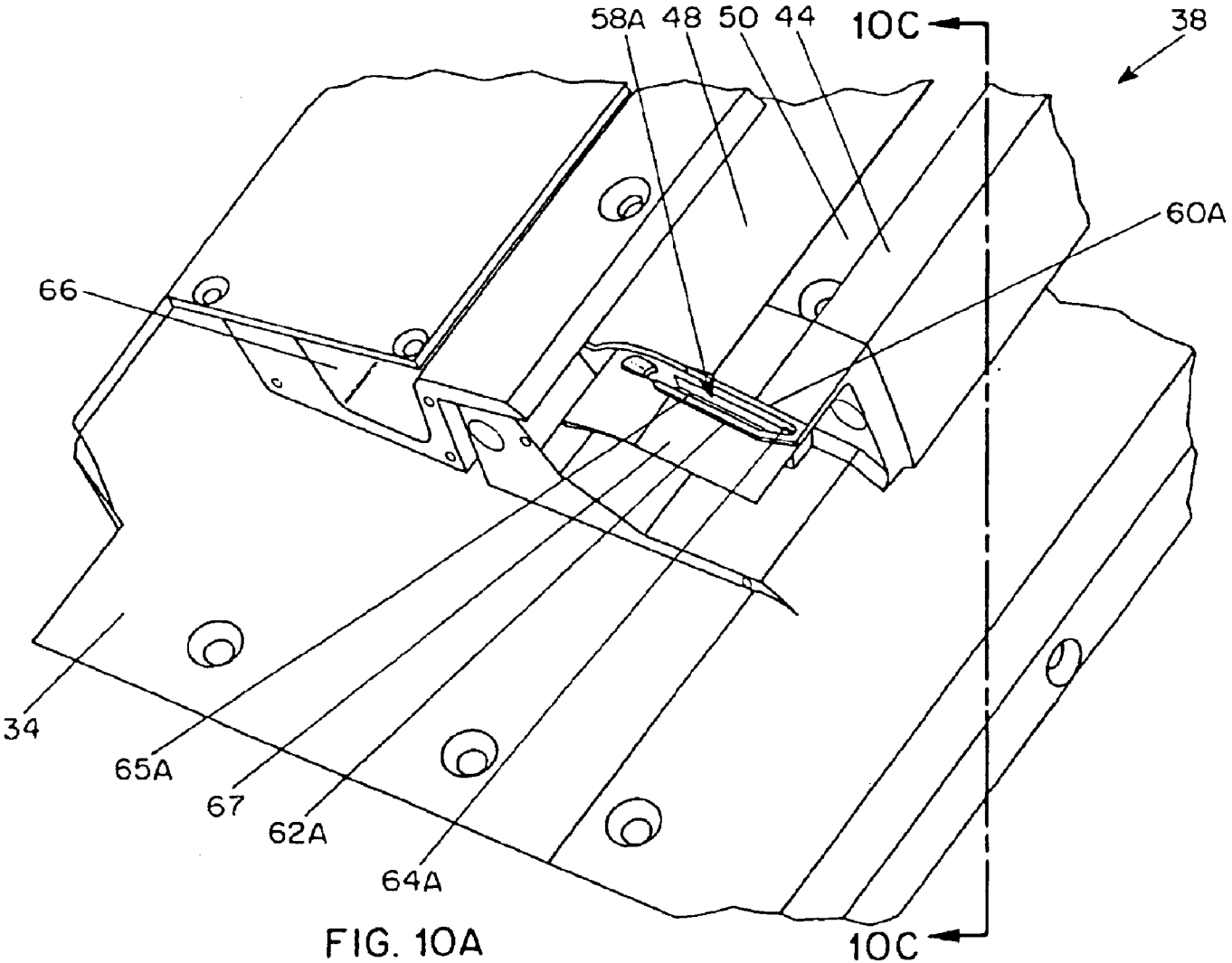
FIG. 10A is a broken-away perspective view, similar to that of FIG. 10, but showing an alternate flexible, labyrinth type end seal.
Figure 10B:
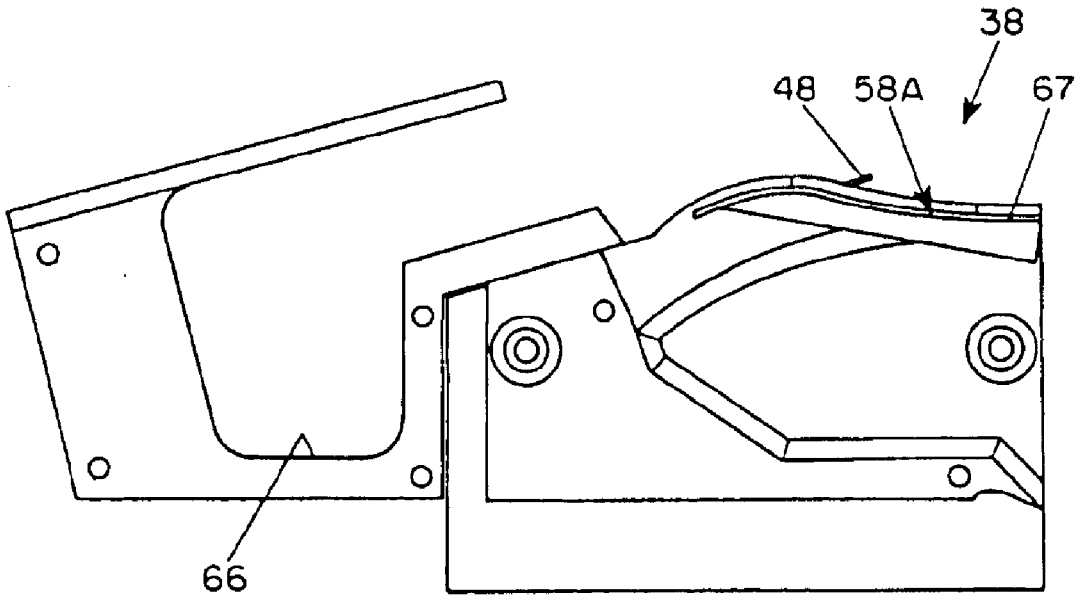
FIG. 10B is an end view of the embodiment of FIG. 10A.
Figure 10C:
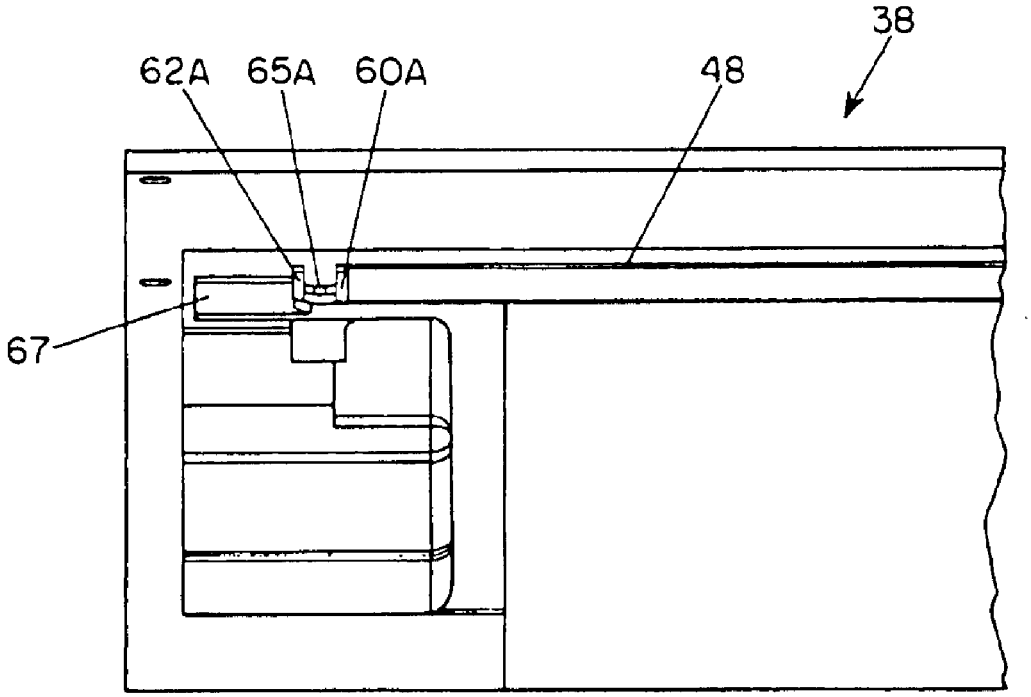
FIG. 10C is a front view taken along line 10C—10C of the embodiment of FIG. 10A.

The left and right end seals 58 are shown best in FIGS. 9A and 10 (and an alternative type of end seal 58A is shown in FIGS. 10A, 10B; and 10C and is described later). The end seals 58 follow the contour of the roll 57 and have a V shape, including inner and outer walls 60, 62, which are joined together at the back and top and are open at the front and bottom. The roll 57 extends beyond the outer walls 62 of the left and right end seals 58, so there is a seal between the roll 57 (or substrate 72) and the nozzle 38 so that only the desired amount of coating that passes between the roll 57 (or substrate) and the upper edge 56 of the metering surface 44 leaves the nozzle 38. Any coating that may carry over beyond the inner walls 60 of the end seals is scraped off at the upper apex 64 of the end seal and is stopped by the outer wall 62, draining down through the lower opening 66 of the end seal 58. The end seal 58 effectively uses hydrodynamics or a labyrinth effect to seal the ends of the pressurized feed bar or nozzle 38, without damaging the application surface. The end seal is designed to accommodate changing angles of the nozzle relative to the roll 57 and various surface shapes of the roll 57 or, if the coating is applied directly to the web 72, the end seal 58 will also accommodate different surface shapes of the web surface. Extending along below each nozzle 38 is a catch trough 66, which catches any coating that may escape past the back seal 48 or past the end seals 58.

The contour of the labyrinth end seal 58 should be shaped to provide a clearance equal to the desired film thickness between the roll 57 (or substrate 72) and the seal 58 at the apex 64 of the seal 58. This clearance should transition smoothly such that, at a point lined up with the trailing edge of the back seal 48, the clearance between the end seal 58 and the roll 57 (or substrate 72) is approximately 0.001" to 0.008".

An alternative preferred embodiment for a labyrinth style end seal 58A is shown in FIGS. 10A, 10B, and 10C. The seal 58A includes generally parallel inner and outer walls 60A, 62A respectively, and these walls 60A, 62A converge at an apex 64 near the trailing edge of the metering surface 44. The spacing between the walls 60A, 62A forms a pocket 65A, which may have a width of a few thousands of an inch or greater. The depth and spacing of the pocket 65A is optimized for the specific coating, roll 57 (or substrate 72) deflection rate, and speed, to achieve a wetted exit roll 57 (or substrate 72), While not permitting enough fluid out to create excessive leakage or slinging of the fluid. The top surface of the inner and outer walls 60A, 62A preferably has a slight slope (in the range of 2 degrees to 10 degrees from the horizontal), sloping toward the inner pocket 65A, which may improve the wetting characteristics. The intent is to have the pocket 65A full of the coating fluid such that it is able to wet the roll 57 (or substrate 72), but not enough to have the pocket 65A under substantial pressure so as to cause spraying or slinging of the coating fluid beyond the end seal 58 or 58A.

A labyrinth end seal 58, 58A may be flexible or rigid. If the roll 57 (or substrate 72) deflects by more than approximately 0.003" across the product range, then a deflectable, self-correcting end seal 58A should be considered. The end seal 58A depicted in FIGS. 10A–10C is designed to provide deflection of the end seal 58A to permit usage with a deflectable roll 57 (or substrate 72). The end seal 58A is deflectable by virtue of the fact that it mounts onto the nozzle 38 by means of a relatively thin and flexible bracket 67 which compensates for the deflection of the roll 57 (or substrate 72). The deflection required of the end seal 58A can be calculated using standard engineering design practices, and it should be designed to match the deflection rate of the roll 57 (or substrate 72) that can be measured directly.

Figure 9B:
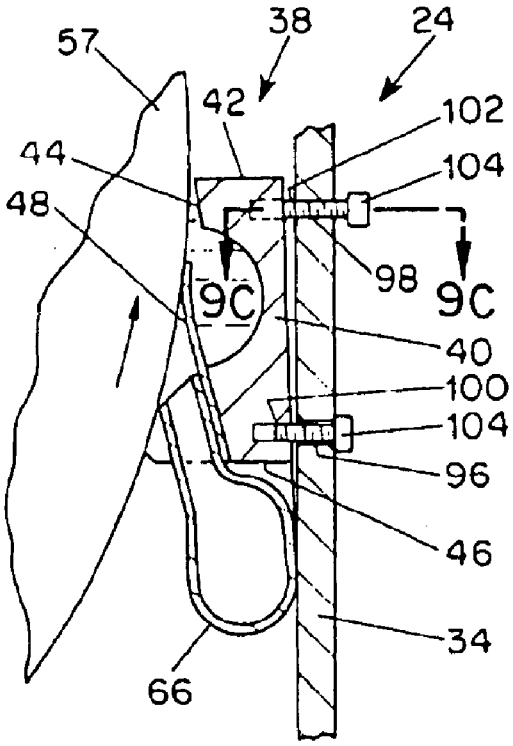
Figure 9C:
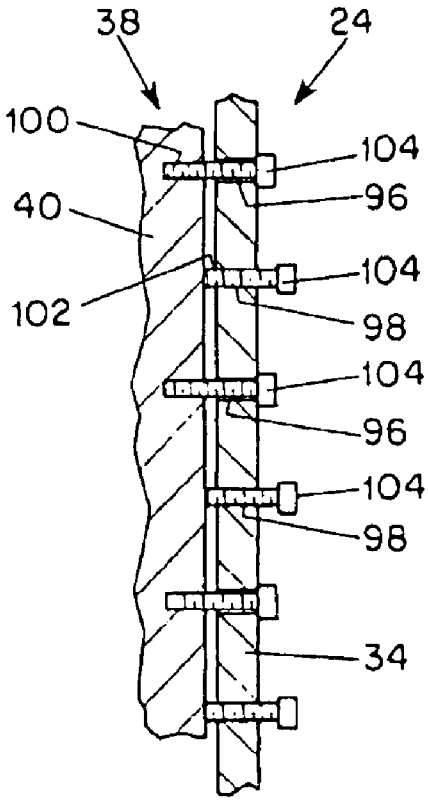
FIG. 9C is a broken-away top view of the connection between the feed nozzle and stiffener of FIG. 9B.

Each of the feed nozzles 38 is coupled to and reinforced by a stiffener 24 (See FIG. 11). In this embodiment, the stiffener 24 includes two walls, 34, 36. The stiffener beam 24 in this embodiment is a fabricated beam that also houses the feed pipes 68, which feed coating to the nozzles 38. The profile of the metering surface 44 of the feed bar or nozzle 38 may be adjusted in order to vary the coating thickness across the width of the web 72 or in order to make the thickness constant by adjusting the position of the metering surface 44 relative to the stiffener 24. As shown in FIGS. 9B and 9C, the stiffener 24 has many stiffener frame pulling apertures 96 and stiffener frame pusher threaded apertures 98 along its length. In the reservoir, there are corresponding feed nozzle pulling threaded apertures 100 and feed nozzle pusher surfaces 102. Adjacent to each stiffener clearance 96 is a feeder nozzle pulling threaded aperture 100. Bolts 104 are inserted through the desired apertures to selectively pull the reservoir towards the stiffener 24 and to push the reservoir away from the stiffener at various positions to achieve the desired profile. It should be noted that, while the reservoir and metering surface are relatively rigid, the stiffener 24 is even more rigid, and this jacking and pulling can achieve slight distortions of the metering surface 44 to achieve the desired profile. While the bolts 104 are currently adjusted manually, it is understood that they may alternatively be adjusted automatically by electro-mechanical or other known means.

Figure 12:
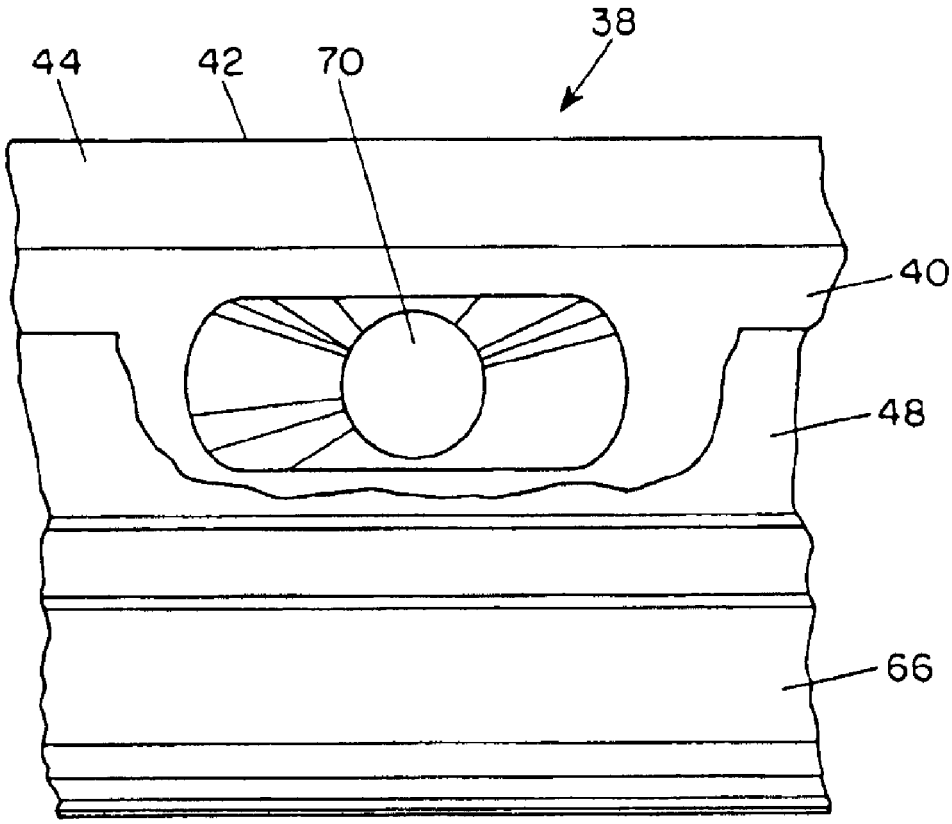
FIG. 12 is a broken-away view taken along the line 12—12 of FIG. 5.

In order to feed pressurized coating to the nozzles 38, there are left and right feed pipes 68, projecting out the left and right ends of the stiffener beam 24 along the axis of rotation of the stiffener beam 24. Each feed pipe 68 bends and extends to its respective nozzle 38. As shown in FIGS. 5 and 12, there are aligned openings 70 through each surface 34, 36 of the stiffener beam 24 and through the respective rear wall 40 of the respective reservoir, which permit coating fluid to pass through the feed pipes 68, through the aligned openings 70, and into the respective reservoir of the nozzle 38. (Only one nozzle 38 will be receiving coating at any given time, because the other nozzle 38 will be inverted and will not be in operating position. However, a nozzle 38 that is out of operating position may be receiving cleaning fluid through its respective feed pipe 68, as will be explained later.)

Coating material is piped under pressure through a respective feed pipe 68 to a respective nozzle 38. In this preferred embodiment, the coating is pumped into a constant head tank, and the head of the coating fluid in the tank maintains a constant operating pressure. There is also a tank of cleaning fluid, and, by switching valves and rotating a cleaning assembly into place, as will be described later, cleaning fluid can be circulated through a nozzle 38 to clean the nozzle.

Figure 17:
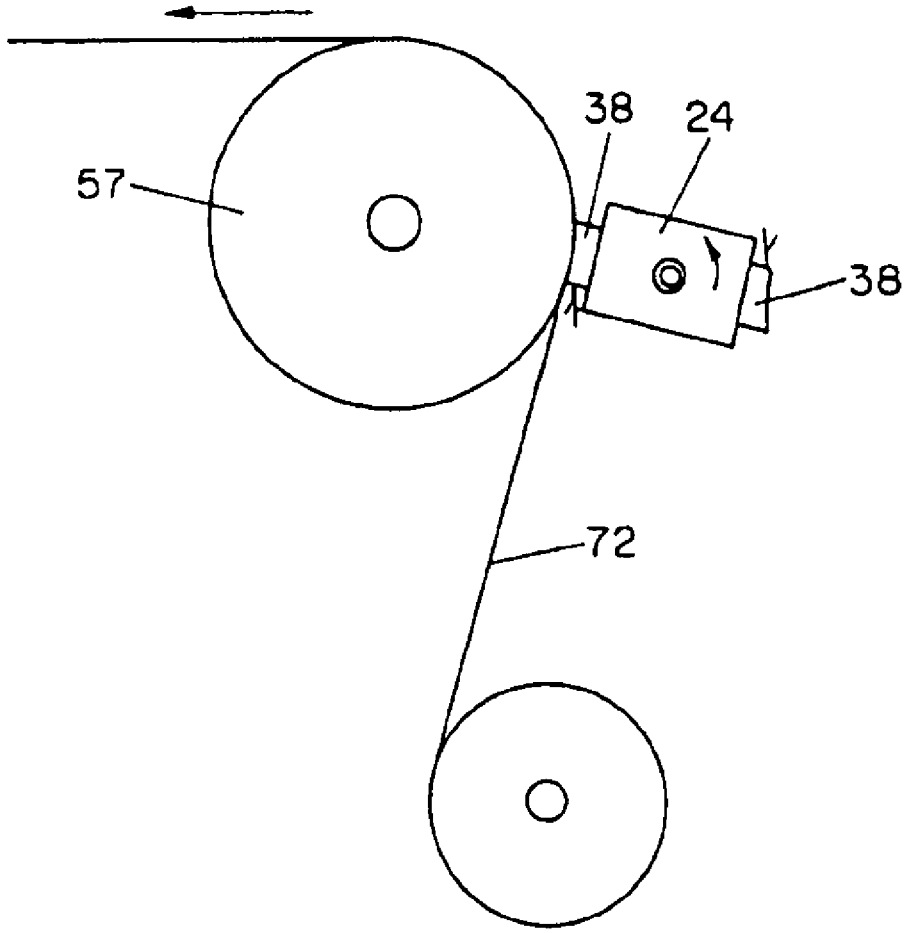
FIG. 17 is a schematic side view of an alternative embodiment of a manner in which a web of material could be coated by the machine of FIG. 18 is a schematic side view of a second alternative embodiment of a manner in which a web of material could be coated by the machine of FIG. 1.
Figure 18:
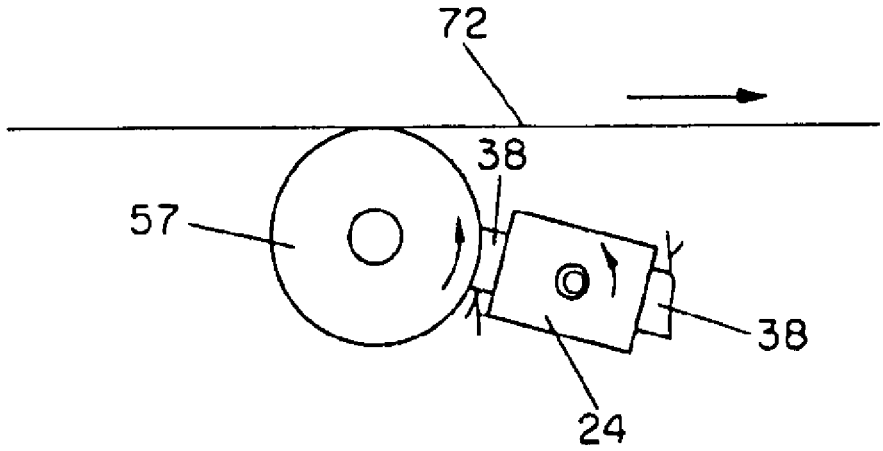
Figure 19:
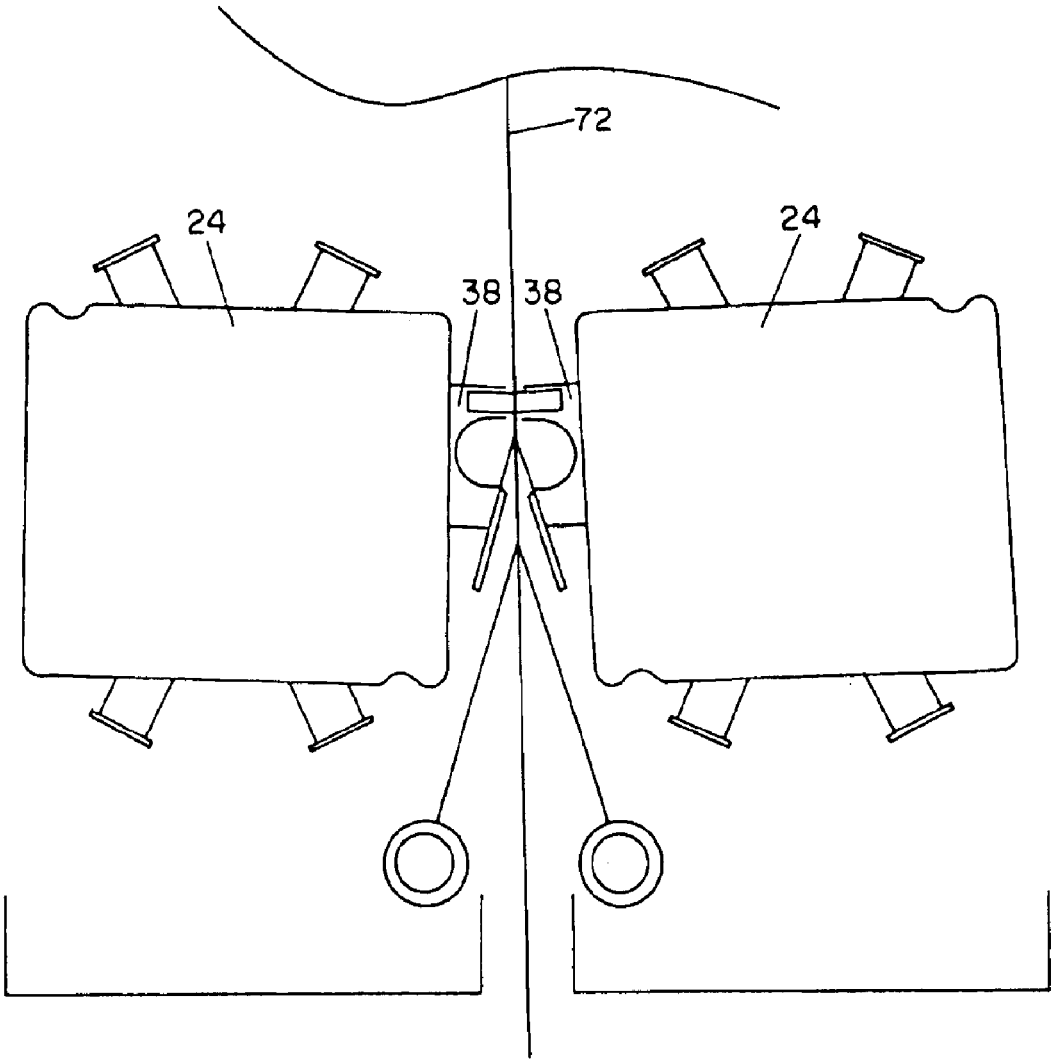
FIG. 19 is a schematic side view of a third alternative embodiment of a manner in which a web of material could be coated by the machine of FIG. 1.

Adjacent to the nozzle 38 which is in the forward, operating position, is the roll 57. In this preferred embodiment, the roll 57 preferably is an applicator roll, which picks up coating from the nozzle 38 and then transfers the coating to a moving web 72 of material rotating over an adjacent backup roll 74. This arrangement is shown schematically in FIG. 3. FIGS. 17, 18, and 19 show alternative arrangements. In FIG. 17, the web 72 of material to be coated passes between the nozzle 38 and the roll 57, so the web 72 is coated directly by the nozzle 38, and the roll 57 functions as a back-up roll. In FIG. 18, the web 72 passes over the roll 57, which picks up coating from the nozzle 38 and transfers the coating to the web 72. In FIG. 19, the web 72 passes between two nozzles 38 and each side of the web 72 is coated directly by a nozzle 38.

There are various sensors and control mechanisms for controlling the relative positions between the metering surface 44 and the roll 57 and the amount of force applied by the metering surface 44, which will be described later.

The stiffener beam 24 is supported by support bearings 26, which are coupled to the support springs 22 through the mounting blocks 23 (See FIG. 14). Each support spring 22 is fixed at one end to one of the nozzle support frame members 16, which, as described above, is mounted for linear motion along the base 12. There is a force sensor 32 mounted on each of the nozzle support frame members 16, and there is a force sensor 32 mounted on each of the roll support frame members 14. The position of each of the frame members 14, 16, is controlled by a motor 20, which rotates a threaded shaft 106, which pushes and pulls its respective frame member 14,16 along a linear track 108, where it is supported by linear bearings 110. Thus, the motors 20 control the relative positions of the nozzle 38 and the roll 57, setting the gap between the metering surface 44 and the roll 57 and controlling the force exerted by the nozzle 38 on the roll 57. In this preferred embodiment, the motors 20 are stepper motors. However, other kinds of motors may be used, such as servo motors and hydraulic servos. The motors 20 may be controlled in response to a central controller, which receives signals from the force sensors 32, thereby controlling the force with which the coating fluid is applied to the roller 57. While the feed nozzle force sensor 32 is shown as being mounted on the frame 16, it may be incorporated into the support spring 22, may be mounted under the support spring 22, or may be incorporated into the feed nozzle slide position/force adjuster linear bearing arrangement 18. The stiffener 24 may be integral with the feed nozzle 38. However, in this preferred embodiment, the stiffener 24 is a separate member, which permits adjustment of the profile of the feed nozzle 38, as was explained above. While stepper motors 20 are used in this embodiment, other control mechanisms, such as hydraulic motors, hydraulic cylinders, and hand cranks could be used instead.

By mounting the feed nozzle 38 on the support springs 22, an additional adjustment is provided. As the fluid pressure builds up between the feed nozzle 38 and the roll 57, the springs 22 extend, causing the stiffener 24 and the on-line feed nozzle 38 to rotate slightly up and away from the roll 57, and, as the fluid pressure is reduced, the springs 22 retract, rotating the feed bar 38 back downwardly and closer to the roll 57, so that a proper metering gap is maintained at the metering surface 44. In this preferred embodiment, the springs 22 are leaf springs having a thickness and arcuate shape designed to maintain the desired metering gap for a particular fluid. It is expected that various types and shapes of springs will be used depending upon the desired thickness and the characteristics of the coating fluid to be used.

By adjusting the shape of the reservoir cavity, the heat build up from the turbulence of the coating material can be controlled. The opening 70 from the feed pipe into the nozzle 38 is tapered to minimize turbulence (See FIG. 12). As the ratio of reservoir cavity cross sectional area to the exposed surface being coated increases, more heat is added to the coating due to turbulence.

As was explained earlier, FIGS. 14 and 15 show a mounting arrangement which permits the stiffener beam 24 to be rotated 180 degrees from first to second operating positions. In the first operating position, one of the nozzles 38 is on-line, and, in the second operating position, the beam 24 is rotated 180 degrees from the first position, thereby putting the second nozzle 38 into operating position. While one example of the mechanism for mounting and rotating the stiffener beam 24 is shown here, many other mechanical or electro-mechanical arrangements could be used. For example, a rotating handle and gearing could be used to control the angular position of the stiffener beam 24 relative to the sleeve 67.

Contact force, reservoir cavity pressure, shape of the metering surface and contact angle are all control actuators. These actuators provide a wide operating control window and can be operated manually or can be fully automated and dynamically controlled via mathematical algorithms or product feedback. In the present embodiment, the bolts 76, 78 are controlled manually.

The pressure feed coating application system 10 enables complete control of the fluid through the application process. Pre-filtered and conditioned fluid is applied under pressure directly to the web 72 or to the applicator roll 57. Thus, there is no opportunity for the phenomena that create foam, skips, voids, shinnies, splotching, or slings to develop. The fluid is not open to the atmosphere, therefore the fluid cannot skin-over or dry-out. By keeping the coating fluid contained and by controlling the shape of the nozzle, the nozzle pressure, nozzle angle, relative positions of the nozzle 38 and roll 57, and the roll hardness, it is possible to provide precise control of the film thickness. Defects associated with unstable or uncontrolled fluid dynamics are eliminated. Coatings may be applied using this equipment at high speeds of over 250 feet per minute with very good appearance (no ribs) at a much wider range of fluid viscosities than was previously possible.

FIG. 17 shows the pressure feed coating application assembly 10 applying coating fluid from the nozzle 38 directly to the product web 72. Applying the coating from the nozzle to an applicator roll for transfer to the product or applying directly from the nozzle to the product provide significant improvements over conventional two and three roll coating systems. Application of pre-metered coating to the applicator roll eliminates the need for using a second or third roll. Improved product characteristics can be achieved with one roll using this method.

Under certain circumstances, it may be advantageous to use this system to apply coating to a roll one removed from an applicator roll. This roll may be operated in either the forward or reverse direction. This system still provides many advantages over conventional two or three roll, Roll Coating Systems.

The pressure feed coating application feed system 10 feeds pressurized coating into the sealed feed bar 38 with pressurized fluid against the roll or substrate as opposed to designed clearances used in die, slot and curtain application systems.

In the preferred embodiment of the present invention, the materials of construction of the stiffener beam and nozzle would typically be metal, usually steel or aluminum.

Figure 13:
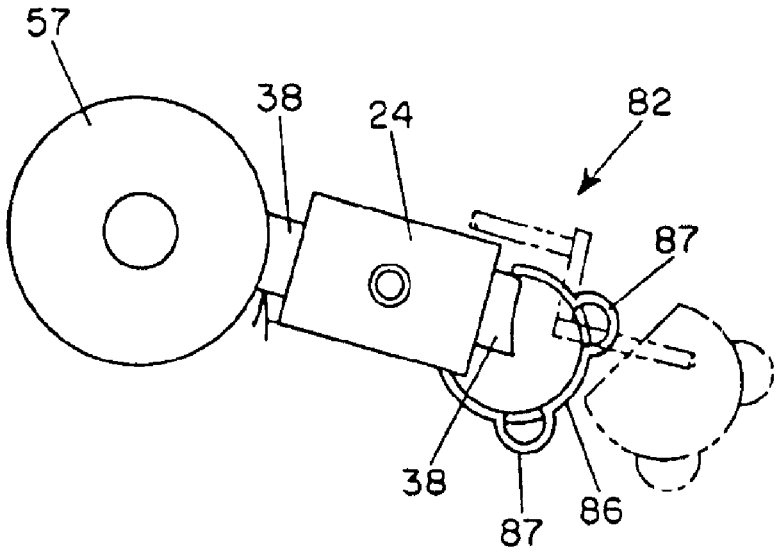
FIG. 13 is a schematic side view showing the nozzle, roll, and nozzle cleaner of FIG. 1.

FIGS. 1 and 13 illustrate a feed nozzle cleaning assembly 82, which is shifted into position by the cylinder 84 to enclose the feed nozzle 38 that is off line. The feed nozzle cleaning assembly 82 includes a cover 86, which seals against the stiffener 24 and against the bottom wall 46 of the feed nozzle 38, enclosing the feed nozzle 38. Cleaning fluid is circulated through the respective feed pipe 68, through the feed nozzle 38, is caught in the cover 86, and is recirculated. Cleaning fluid is also sprayed through cleaning nozzles 87 in the cover 86 to clean the feed nozzle 38. In normal operation, the off-line nozzle 38 will be cleaned while an on-line nozzle remains in service, as shown in FIG. 13.

Figure 16:
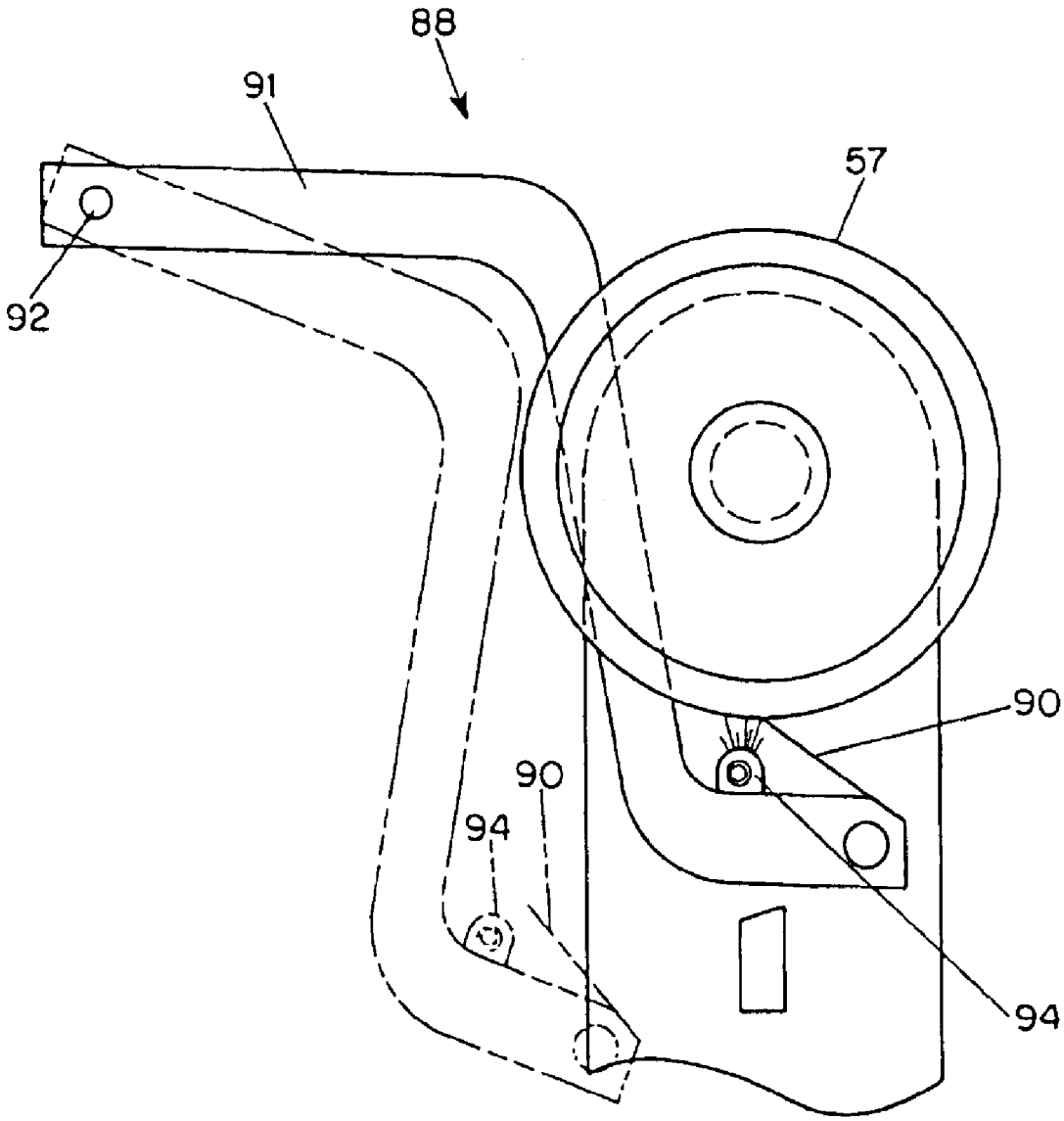
FIG. 16 is a schematic side view of a roll cleaning mechanism made in accordance with the present invention.

FIG. 16 illustrates an applicator roll cleaning assembly 88, which is a means of cleaning the applicator roll 57. In the preferred embodiment of the present invention, the cleaning assembly 88 includes a cleaning blade 90 mounted on an arm 91, which is coupled to a cleaning blade actuator (not shown), which causes the cleaning blade arm 91 to pivot about the axis 92. The roll cleaning assembly 88 also includes cleaning nozzles 94, which spray cleaning fluid on the roll 57. While this means of cleaning the applicator roll 57 is manual, it will be obvious to anyone skilled in the art that it could readily be converted to an automated cleaning system. The present design provides the space and layout that permits the use of such a cleaning system, which could not be used in prior art coating systems.

It will be obvious to those skilled in the art that modifications and additions may be made to the embodiments described above without departing from the scope of the present invention.

What is claimed is:

1. An apparatus comprising:

an elongated nozzle having an elongated opening defined along its length by a flexible back seal and a metering surface defined with respect to an upward direction of travel of a substrate or roll past the elongated opening, the substrate or roll having a width, the direction of travel such that the substrate or roll first encounters the flexible back seal and later encounters the metering surface, the elongated opening having first and second ends separated by a distance, the distance less than the width of the substrate or roll; the nozzle defining a back direction away from the substrate or roll and a front direction toward the substrate or roll;

a first end seal at the first end;

a second end seal at the second end;

the first seal comprising inner and outer walls each extending in the direction of travel and each having an edge in the direction of the substrate or roll;

the second seal comprising inner and outer walls each extending in the direction of travel and each having an edge in the direction of the substrate or roll;

the inner walls of the first and second seals disposed toward each other;

the outer walls of the first and second seals disposed away from each other;

the inner and outer walls of the first seal joined together at top ends thereof;

the inner and outer walls of the second seal joined together at top ends thereof;

the edges of the inner and outer walls of the first and second seals shaped to fit the substrate or roll.

2. The apparatus of claim 1 wherein the inner and outer walls of the first seal are joined together at the back thereof, and wherein the inner and outer walls of the second seal are joined together at the back thereof.

3. The apparatus of claim 1 wherein the first seal and the second seal are shaped to provide, at a point lined up with a trailing edge of the back seal, a clearance of approximately 0.001 inch to 0.008 inch with the substrate or roll.

4. The apparatus of claim 1 wherein:

the first end seal is mounted to the nozzle by means of a flexible bracket; and the second end seal is mounted to the nozzle by means of a flexible bracket.

5. The apparatus of claim 1 wherein:

the top surface of the inner and outer walls of the first seal has a slope downwards from the horizontal in the range of 2 degrees to 10 degrees; and the top surface of the inner and outer walls of the second seal has a slope downwards from the horizontal in the range of 2 degrees to 10 degrees.

6. The apparatus of claim 1 further comprising coating fluid under a first pressure through the nozzle toward the substrate or roll;

the shape of the first end seal chosen to give rise to a second pressure of the coating fluid within a pocket defined by the inner and outer walls of the second seal, the third pressure less than the first pressure;

the shape of the second end seal chosen to give rise to a third pressure of the coating fluid within a pocket defined by the inner and outer walls of the second seal, the third pressure less than the first pressure.

7. The apparatus of claim 1 further comprising a drip pan positioned below the first end seal and below the second end seal.

8. An apparatus comprising:

an elongated nozzle having an elongated opening defined along its length by a flexible back seal and a metering surface defined with respect to an upward direction of travel of a substrate or roll past the elongated opening, the substrate or roll having a width, the direction of travel such that the substrate or roll first encounters the flexible back seal and later encounters the metering surface, the elongated opening having first and second ends separated by a distance, the distance less than the width of the substrate or roll; the nozzle defining a back direction away from the substrate or roll and a front direction toward the substrate or roll;

a first end seal at the first end;

a second end seal at the second end;

the first seal comprising inner and outer walls each extending in the direction of travel and each having an edge in the direction of the substrate or roll;

the second seal comprising inner and outer walls each extending in the direction of travel and each having an edge in the direction of the substrate or roll;

the inner walls of the first and second seals disposed toward each, other;

the outer walls of the first and second seals disposed away from each other;

the inner and outer walls of the first seal joined together at top ends thereof;

the inner and outer walls of the second seal joined together at top ends thereof;

the edges of the inner and outer walls of the first and second seals shaped to fit the substrate or roll;

the first end seal mounted to the nozzle by means of a flexible bracket; and the second end seal mounted to the nozzle by means of a flexible bracket.

9. The apparatus of claim 8 wherein the inner and outer walls of the first seal are joined together at the back thereof, and wherein the inner and outer walls of the second seal are joined together at the back thereof.

10. The apparatus of claim 8 further comprising a drip pan positioned below the first end seal end seal and below the second end seal.

* * * * *